United States Patent [19]

Keller

[11] Patent Number: 4,504,369

[45] Date of Patent: Mar. 12, 1985

[54] METHOD TO IMPROVE THE PERFORMANCE OF NON-CONSUMABLE ANODES IN THE ELECTROLYSIS OF METAL

[76] Inventor: Rudolf Keller, R.D. #3, Roundtop Rd., Export, Pa. 15632

[21] Appl. No.: 578,021

[22] Filed: Feb. 8, 1984

[51] Int. Cl.[3] ..... C25C 3/00; C25C 3/06

[52] U.S. Cl. ..... 204/67; 204/64 R; 204/64 T; 204/70

[58] Field of Search ..... 204/67, 291, 64 R, 64 T, 204/70

[56] References Cited

U.S. PATENT DOCUMENTS

| | | | |
|---|---|---|---|
| 3,718,550 | 2/1973 | Klein | 204/67 |
| 3,930,967 | 1/1976 | Alder | 204/67 |
| 3,930,969 | 1/1976 | Chen | 204/105 |
| 3,960,678 | 6/1976 | Alder | 204/67 |
| 3,974,046 | 8/1976 | Alder | 204/67 |
| 4,374,761 | 2/1983 | Ray | 252/519 |
| 4,392,925 | 7/1983 | Alder et al. | 204/67 |
| 4,410,403 | 10/1983 | Jacobs et al. | 204/67 |

OTHER PUBLICATIONS

Aluminium Smelter Technology, Aluminium Verlag Duesseldorf, (1980), K. Grjotheim and B. J. Welch.

Inert Anodes for Aluminium Electrolysis in Hall-Heroult Cells, *Aluminium*, vol. 57, pp. 146–150 and pp. 228–231, (1981).

Anodic Corrosion of Sintered Oxide Materials in Hall-Heroult Melts, (1983), James M. Clark.

*Primary Examiner*—Howard S. Williams

*Attorney, Agent, or Firm*—H. Keith Hauger

[57] ABSTRACT

In the electrolytic production of metal employing non-consumable anodes, the performance of these anodes is improved by adding predetermined measured amounts of anode constituent materials to the electrolyte melt in a controlled manner in order to control the corrosion and solubility of the anode.

13 Claims, 1 Drawing Figure

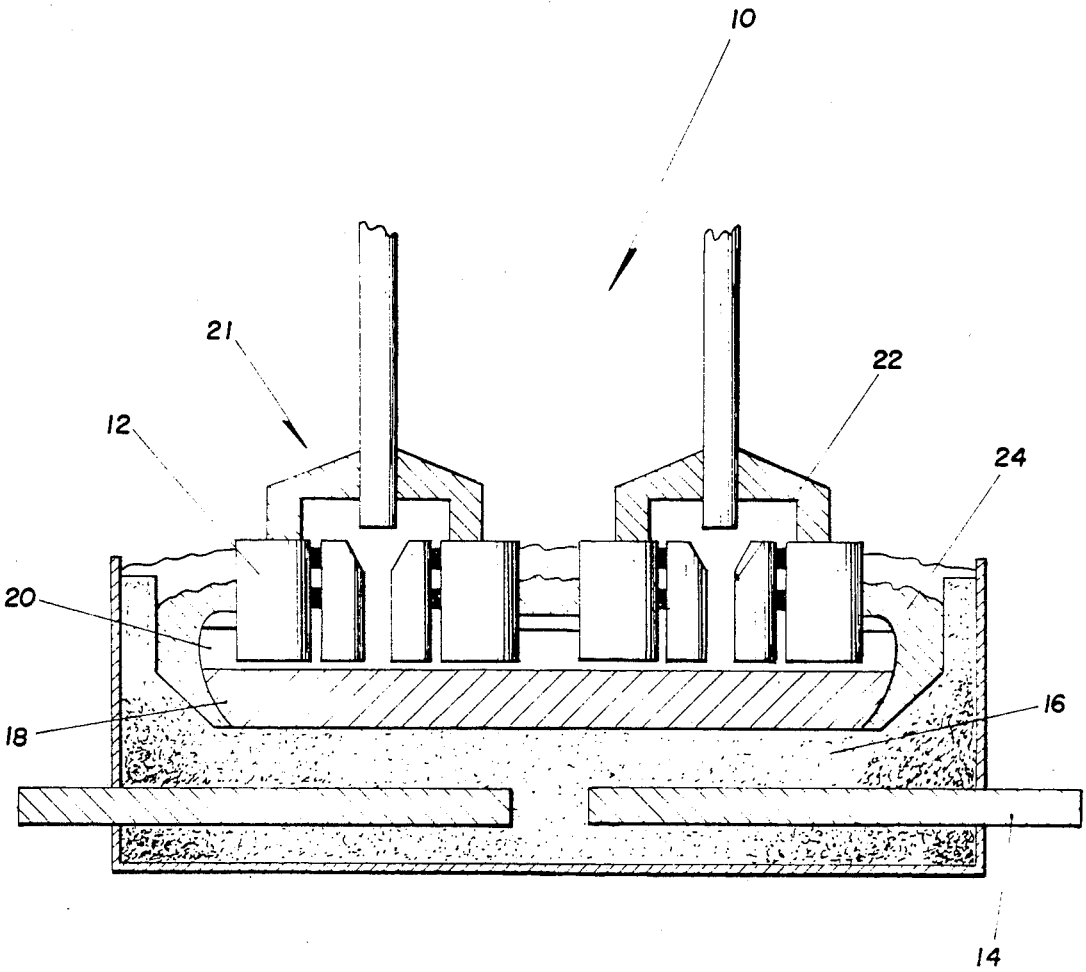
10
21
22
12
24
20
18
16
14

METHOD TO IMPROVE THE PERFORMANCE OF NON-CONSUMABLE ANODES IN THE ELECTROLYSIS OF METAL

BACKGROUND OF THE INVENTION

The present invention relates to the production of metal, such as aluminum, and the like, by electrolysis of a compound of the metal which is dissolved in a molten solvent, and more particularly, to a method for reducing in the electrolysis, the corrosion of non-consumable anodes which usually contain oxide compounds and, in which electrolytic process, oxygen gas is caused to evolve.

Presently, the Hall-Heroult Process, as described in "Aluminum Smelter Technology", *Aluminum Verlag Duesseldorf,* by K. Grjotheim and B. J. Welch, (1980), is commonly used to produce aluminum. Aluminum oxide (alumina) is dissolved in cryolitic melt and electrolyzed in an electrolytic cell. Aluminum forms cathodically at the molten metal pool surface and collects on the carbonaceous cell bottom. Carbon anodes, suspended in the melt, participate in an anodic reaction to form carbon oxides at the anodic surface, resulting in the carbon anode continuously being consumed.

Recently, electrolytic cells were developed in which inert or non-consumable anodes are substituted for the carbon anodes. In such cases, the anodes are not consumed, per se, in the same manner as the carbon, anodes and oxygen gas which can be salvaged for future use is liberated from the decomposition of the alumina. However, the molten bath and the produced oxygen gas cause the anodes to corrode and dissolve in the melt.

The use of inert anodes has several advantages as compared to the consumable carbon anodes and, therefore, is most attractive to the industry. These advantages are set forth in U.S. Pat. No. 3,930,967 issuing to Hanspeter Alder on Jan. 6, 1976, and are briefly stated as: (1) eliminating the need for maintaining a separate manufacturing plant for the production of carbon anodes; (2) eliminating the use of petroleum coke with a low ash content in order to lessen the contaminants in the produced aluminum; (3) creating a stable geometry for the anode thereby permitting a more energy-efficient electrode configuration and cell design, especially if the non-consumable anodes are combined with dimensionally stable cathodes which are presently being developed; and (4) lessening the need for replacing the anodes which allows the electrolytic cell to be operated more consistently as to result in greater aluminum production with fewer undesirable environmental emissions.

The composition, preparation and design features for such non-consumable anodes have been described by several authors, as has been summarized by K. Billehaug and H. A. Oye in "Inert Anodes for Aluminium Electrolysis in Hall-Heroult Cells", *Aluminium,* Volume 57, pp. 146–150 and pp. 228–231, (1981).

Generally, anodes whose working surfaces are ceramic oxides are being employed. In addition, improvements to the basic ceramic oxide anode are evolving, such as Cermet materials containing oxide and metal. Compositions based on $SnO_2$ as the main component have been described in early U.S. Pat. Nos. 3,718,550, 3,930,969, 3,960,678, and 3,974,046; $Fe_2O_3$-NiO mixtures have been outlined in U.S. Pat. No. 4,374,761; some of these compositions have also been mentioned along with ferritic compositions, i.e. $MnFe_{2.04}O_4$, $(MnZn)Fe_{2.04}O_4$, $NiFe_{2.04}O_4$, by James M. Clark in a recent publication entitled "Anodic Corrosion of Sintered Oxide Materials in Hall-Heroult Melts", at a meeting of the Electrochemical Society held in Washington, D.C. on Oct. 12, 1983. As is apparent, all of these non-consumable electrodes or anodes are essentially composed of sintered ceramic oxides with electronic conductance. Since in the electrolytic process, oxygen gas and molten bath and their motion create a harsh environment, the efficiency and life of these oxidic anodes is eventually impaired in that these anodes are susceptible to corrosion through chemical reactions and dissolution in the melt.

The performance and life of inert anodes such as those outlined in the preceding paragraph is, under practical operating conditions, essentially determined by their dissolution rate occurring at the anode surface, which dissolution rate, in effect, is equated to the corrosion rate of the inert anode. This dissolution rate depends on the mass transfer conditions at the anode, on the saturation concentrations of the anode constituent oxide compounds in the electrolyte melt, and on the actual concentration of these anode constituent compounds in the electrolyte bulk or overall liquid during electrolysis. The mass transfer conditions are affected by the shape of the electrode, and more importantly, by the gas evolution, the amount of oxygen gas evolved being affected by current density and the gas bubble size being affected by electrolyte composition and the dimension of the anodic surface. Electrolytic gas evolution at the electrodes generally produces very high mass transfer rates.

The saturation concentrations of electrode constituent compounds in the melt depend on the type of compounds employed and on the electrolyte composition and temperature, i.e. a high aluminum oxide content for the melt generally decreases the solubility rate of oxidic compounds, which compounds are normally electrode constituent compounds.

The bulk concentrations of anode constituent compounds existing in the electrolyte melt are essentially a result of the dissolution rates of such compounds at the anode or from other sources and of their removal rate from the electrolyte, the latter process mainly occurring by the electrolytic reduction at the cathode where in some instances a partial subsequent reoxidation may occur.

SUMMARY OF THE PRESENT INVENTION

It is, therefore, an object of the subject invention to improve the production of a metal in an electrolytic process by improving a method for the electrolysis which prolongs the life and enhances the performance of non-consumable anodes.

In the present invention, the bulk concentration of anode constituent materials in the electrolyte is manipulated or brought to a desirable state by adding appropriate amounts of anode constituent compounds which may be oxides in a controlled manner to the electrolyte solution. By maintaining a high concentration level in the electrolyte adjacent to the anode surface, dissolution and thus corrosion rates of the anode are reduced. Such additions may not seem at first to be favorable since one would naturally expect that an increase in metal contamination in the cell would outweigh the prolonged life or improved performance of an inert electrode. Surprisingly, however, such additions lead to overall favorable results because their effect on anode life is much more significant than their impact on metal purity. If for any reason, one being to achieve higher metal purity, it is desirable to reduce the contents of anode constituent materials in the metal, then the essential step would be to reduce their reduction rate at the cathode; this can be done, as indicated in U.S. Pat. No. 4,392,925, by limiting the cathode surface area, or by reducing mass transfer rates by other means.

Based on anode corrosion data presented by F. W. Baker in "Inert Anodes for Aluminum Smelting", *Report DOE-Cons*-40158-8, (January 1983), and an estimate of mass transfer rates at these anodes from information obtained with similar, but aqueous, systems, it can be shown that the bulk concentration of anode constituents in electrolytes of cells operating under practical conditions is relatively high. Mass transfer coefficients at the anodes are much higher than those at the cathodes. Under these conditions, a particularly significant benefit in anode life can be achieved by the addition of anode constituent compounds to the electrolyte as taught by the present invention. If the anode contains oxides, then oxide compounds or compounds that form the appropriate oxides in combination with the oxide content of the melt are dissolved in the electrolyte melt to an extent that the saturation concentration of the anodic oxides in the melt is closely approached so that the dissolution rates of oxide compounds from the anodes are substantially retarded or eliminated.

As an example of using the method taught by the present invention, if in the melt including alumina the bulk concentration of $Fe_2O_3$ amounts to 95% of the saturation concentration under given conditions, an addition of ferric anode compounds of an amount corresponding to the pre-established corrosion rate of the anode containing $Fe_2O_3$ may increase the concentration in the electrolyte bulk to within less than a percent of the saturation concentration, and the corrosion rate of a ferric anode is consequently reduced by up to more than ten times, as compared to the present practice of not adding $Fe_2O_3$ or other ferric compounds to the electrolyte solution. At the same time the reduction rate of Fe+III at the cathode is only increased by about 5%, and the corresponding increase of iron contaminant in the metal is relatively small, which illustrates the statement made previously that added amounts of anode constituent compounds do not affect the purity of the metal to any significant effect.

More particularly, it is an object of the present invention to provide a method for electrolytically producing a metal from an electrolyte solution containing a metal compound where the life and performance of inert, non-consumable anodes are improved by adding measured amounts of critical components of slowly dissolving anode constituent compounds to the electrolyte solution in a manner that the anode constituent materials in the anodes dissolve at a substantially reduced rate. The respective anode constituent compounds are primarily oxides but can also be halides, sulfides or nitrides if these compounds and not oxides are being electrolyzed.

BRIEF DESCRIPTION OF THE PRESENT INVENTION

These objects, as well as other novel features and advantages of the present invention, will be better appreciated and understood when the following description is read along with the accompanying drawing of which:

The FIGURE is a cross sectional view of a cell utilized in practicing the subject invention.

DETAILED DESCRIPTION OF THE PRESENT INVENTION

As stated previously, the present invention involves a method for improving the performance of non-consumable anodes in an electrolytic cell by adding to the electrolytic melt for dissolution therein an oxide compound or other compound constituents contained in the anode, which compounds in the anode were previously caused to slowly corrode by dissolving at the anodic surface. The addition of this compound or critical compound constituents of the anode is made by adding predetermined measured amounts to the electrolyte in a more or less continuous fashion throughout the electrolysis process. It is possible to add these compounds either separately or mixed in with the alumina feed. Instead of dissolving the compounds per se, critical components of them can be added such that the compounds form through a reaction; for instance, halides can react with aluminum oxide in the electrolyte to form the desired oxides, or metal can be oxidized to accomplish the same result. Alternatively, solid surfaces containing these required compounds can be made available as sacrificial materials, which surfaces would have to be relatively extensive or exposed to forced convention to be sufficiently effective.

A preferred embodiment of the present invention will now be described with reference to the FIGURE which illustrates a typical Hall-Heroult type of cell 10 using non-consumable anodes 12 instead of consumable ones. For purposes of explaining the subject invention, anodes 12 consist of an oxide compound.

The principals, background, and significant components of an electrolytic cell can be found in some or all of the aforesaid references, and therefore, will not be discussed in detail here.

A cathode or bus bar 14 is embedded in a carbonaceous lining 16, which, in turn, outlines a cavity for receiving molten aluminum 18 produced in the electrolytic process from the alumina-cryolite melt 20. Extending down into melt 20 are the inert anode assemblies 21; the anode 12 at its surface area exposed to the electrolyte consisting of a mixture of $Fe_2O_3$-NiO. The center piece of the anode assembly 21 has an opening 22 for which purpose will be explained shortly. A top cover of frozen electrolyte crust 24 extends over the melt 20 and adheres to the anode assembly 21.

The anodic reaction occurs at this surface area of anode assemblies 21 exposed to the molten electrolytic bath 20, and the cathodic reaction occurs where melt 20 contacts the surface of the molten aluminum 18 which aluminum collects in the cavity formed by lining 16. The anode by-product is oxygen gas, which has a stirring effect (i.e. increases mass transfer rates) at the exposed anode surface thereby promoting corrosion of the anode 12 by dissolution of the oxide anode constituent compounds into the melt. To reiterate, this corrosion process is counteracted by the present invention which raises the concentration level of these oxide compounds in the melt through additions to the melt, thus reducing the rates of corrosion by dissolution.

In order to determine the amount of oxide anode constituent compounds which are to be added to the electrolyte, the cell is initially operated under normal operating conditions and the corrosion rate of the inert anode is established either by examining, through known methods and devices, similar sample anodes containing the same oxide compounds, or by determining the amount and content of the anode oxide constituents in the molten aluminum 18 through known methods and devices, not forgetting to duly consider other possible sources for the existence of these anode oxide constituents in the molten aluminum.

For instance, for an inert anode composed of $Fe_2O_3$ and NiO, the measured amounts of $Fe_2O_3$ and NiO correspond to those amounts which were observed to have been dissolved from the anode initially, such amounts can then be added to dissolve in the melt by adding them mixed in with the alumina feed or separately from the feed. A higher concentration of dissolved $Fe_2O_3$ or NiO in the electrolyte now results, and the corrosion rate of the anode is reduced. As removal rates of these compounds also are increased at the higher concentration in the electrolyte, the above procedure for establishing anode losses and tailoring the oxide additions accordingly can be repeated if desired until the amount for minimum anode corrosion is reached.

The addition of these anode constituent oxide compounds can be made such that the solubility limits for the anodes in the electrolyte melt are exceeded. This will assure minimum anode corrosion rates, however, the percent of impurities in the produced metal may be somewhat higher. This approach, therefore, will be selected where impurity levels in the metal are not so critical an issue.

As mentioned above, anode constituent oxide compounds are added through center opening 22 of anode assemblies 21, and can be added separately or mixed in with the alumina feed as the electrolytic process progresses.

Although an alumina electrolysis cell with a traditionally constructed cathode has been selected to describe the subject invention, the present invention is also applicable in advanced cells having nonconventional cathodes and electrode arrangements, i.e. cells employing horizontal, vertical, or slanted thin-metal-layer cathodes, and non-consumable anodes. Also, it is to be emphasized that the subject invention has been explained in light of anodes containing oxides wherein oxides are added to the melt 20; however, anodes can contain halides, sulfides, or nitrides, in which instance, the respective compound is added to melt 20.

Even though the subject invention discloses the use of a critical compound of an inert anode, the spirit of the subject invention would not be destroyed if a critical compound of an inert cathode is employed.

In accordance with the provisions of the patent statutes, I have explained the principle and operation of my invention and have illustrated and described what I consider to represent the best embodiment thereof.

I claim:

1. A method for electrolytically producing a metal from an electrolyte melt containing a metal compound being electrolyzed where the life and performance of an inert, non-consumable anode is improved, and where said anode consists of at least one constituent compound that slowly dissolves in the electrolyte, the steps comprising:

adding amounts of a critical component of constituent compound of said inert, non-consumable anode to said electrolyte melt in a manner that said component dissolves to an extent that the dissolution rate of said anode is reduced, said amounts being selected to correspond to a percentage of the dissolution rate of said anode constituent compound experienced without any said addition.

2. A method for electrolytically producing a metal from an electrolyte melt containing a metal compound being electrolyzed where the life and performance of an inert, non-consumable anode is improved, and where said anode consists of at least one constituent compound that slowly dissolves in the electrolyte, the steps comprising:

adding amounts of a critical component of constituent compound of said inert non-consumable anode to said electrolyte melt in a manner that said component reacts in a manner that the dissolution rate of said anode is reduced, said amounts being selected to correspond to a percentage of the dissolution rate of said anode constituent compound experienced without any said addition.

3. A method according to claim 1 or 2, wherein said adding of said amounts of said critical component of said constituent compound of said anode is such that the solubility limit of said anode compound in said electrolyte melt is closely approached and maintained.

4. A method according to claim 1 or 2, wherein said adding of said amounts of said critical component of said constituent compound of said anode is such that the amounts exceed the quantity necessary to reach the solubility limit of said constituent compound.

5. A method according to claim 1 or 2, wherein said adding of said amounts of said critical component of said constituent compound of said anode is made through an opening in said inert anode.

6. A method according to claim 1 or 2, wherein said added critical component of said constituent compound of said anode is combined with the feed of said metal compound to be electrolyzed such that said addition to the electrolyte melt is continuous throughout the electrolytic process.

7. A method according to claim 1 or 2, wherein addition of said critical component of said constituent compound of said anode is accomplished by selecting cell feed materials that contain said predetermined amounts of said critical component as impurities.

8. In a method according to claim 1 or 2, wherein said anode consists of at least one oxide compound.

9. In a method according to claim 8, wherein said added critical component of said constituent compound of said anode to said electrolyte melt is contained in an oxide compound.

10. In a method according to claim 2, wherein said added critical component of said constituent compound of said anode to said electrolyte melt is contained in a halide compound of said oxide compound for said anode.

11. In a method according to claim 2, wherein said added critical component of said constituent compound of said anode to said electrolyte is a metal that forms said constituent compound through reaction.

12. A method according to claim 1 or 2, wherein said amounts are determined by examining the corrosion rate of said inert anode prior to making said additions of said critical constituents to said melt.

13. A method according to claim 1 or 2, wherein in said electrolysis, molten metal is produced and wherein said amount are arrived at by determining the amount and content of said anode constituents in said molten metal prior to making said additions of said critical constituent to said melt.

* * * * *